US005154416A

United States Patent [19]

Smull et al.

[11] Patent Number: 5,154,416

[45] Date of Patent: Oct. 13, 1992

[54] BOTTOM HAND BAT SWING DEVELOPER

[76] Inventors: Joseph C. Smull, 4120 Heather La., Orefield, Pa. 18069; George Spector, 233 Broadway RM 3815, New York, N.Y. 10007

[21] Appl. No.: 715,555

[22] Filed: Jun. 14, 1991

[51] Int. Cl.[5] ..... A63B 69/40

[52] U.S. Cl. ..... 273/26 C; 273/189 R; 273/191 R; 273/29 A; 273/187.2

[58] Field of Search ..... 273/26 C, 29 A, 188 R, 273/189 R, 191 B, 193 A, 186 C, 186 A, 208

[56] References Cited

U.S. PATENT DOCUMENTS

| | | | |
|---|---|---|---|
| 475,432 | 5/1892 | Blades | 273/189 R |
| 2,808,267 | 10/1957 | Heaton | 273/189 R |
| 2,809,043 | 10/1957 | Brouwer | 273/189 R |
| 3,101,196 | 8/1963 | Ferrara | 273/188 R |
| 3,188,090 | 6/1965 | Job | 273/189 R |
| 3,595,583 | 7/1971 | Oppenheimer | 273/26 C |
| 4,582,325 | 4/1986 | Yuhara | 273/26 C |
| 4,662,640 | 5/1987 | Grander | 273/191 B |

FOREIGN PATENT DOCUMENTS

| | | | |
|---|---|---|---|
| 165960 | 7/1921 | United Kingdom | 273/188 R |

*Primary Examiner*—Theatrice Brown

[57] ABSTRACT

A bottom hand swing developer for a batter is provided and consists of a harness worn on the upper torso of the batter and a restraining member of predetermined length disposed between the harness and a wrist of a top hand of the batter. The top hand will be restricted from dominating the batting swing, while the bottom hand will participate equally with the top hand when the batter swings the bat to hit the ball.

3 Claims, 1 Drawing Sheet

BOTTOM HAND BAT SWING DEVELOPER

BACKGROUND OF THE INVENTION

The instant invention relates generally to sports equipment and more specifically it relates to a bottom hand swing developer which provides a mechanism applied to the upper body of a batter that will improve their swing.

There are available various conventional sports equipment which do not provide the novel improvements of the invention herein disclosed.

SUMMARY OF THE INVENTION

A primary object of the present invention is to provide a bottom hand swing developer that will overcome the shortcomings of the prior art devices.

Another object is to provide a bottom hand swing developer that is an elastic strap applied to the upper body of a batter that will restrict the movement of the top hand so that it will improve their swing.

An additional object is to provide a bottom hand swing developer that can be utilized by either a left hand batter and a right hand batter to improve their swing.

A further object is to provide a bottom hand swing developer that is simple and easy to use.

A still further object is to provide a bottom hand swing developer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
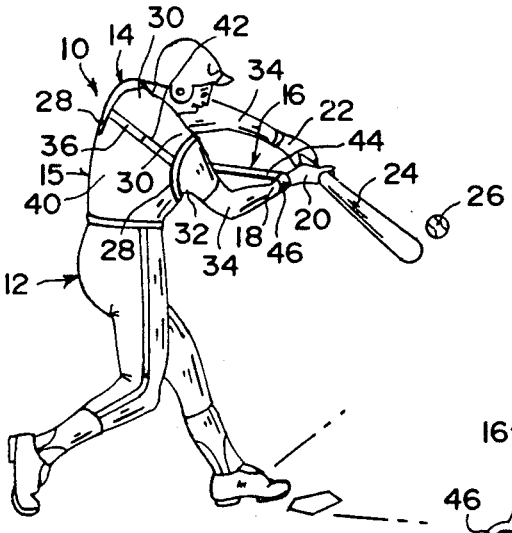
FIG. 1 is a perspective view of a batter in a batting stance wearing the instant invention.

Turning now descriptively to the drawings, in which similar reference characters denote similar elements throughout the several views, the Figures illustrate a bottom hand swing developer 10 for a batter 12 which consists of a harness 14 worn on the upper torso 15 of the batter 12 and a restraining member 16 of predetermined length disposed between the harness 14 and a wrist 18 of a top hand 20 of the batter 12. The top hand 20 will be restricted from dominating the batting swing, while the bottom hand 22 will participate equally with the top hand 20 when the batter 12 swings the bat 24 to hit the ball 26.

The harness 14 includes a pair of elastic loop members 28, each extending about the shoulder 30 and armpit 32 of each arm 34 of the batter 12. A pair of elastic straps 36 are connected between the loop members 28 to extend across the front 38 and back 40 of the upper torso 15 of the batter 12. A pair of fasteners 42 are also provided, with each for adjustably securing each elastic strap 36 between the loop members 28 on the upper torso 15 of the batter 12 so that a right handed and left handed batter 12 can utilize the harness 14.

The restraining member 16 includes an elastic extension member 44 connected at one end to one of the elastic loop members 28 of the harness 14. A band 46 is connected to other end of the elastic extension member 44 to be worn about the wrist 18 of the top hand 20 of the batter 12. A fastener 48 is on the band 46 for adjustably securing the band 46 about the wrist 18 of the top hand 20 of the battery 12. A fastener 50 is also provided for adjustably changing and retaining the length of the elastic extension member 44.

Figure 2:
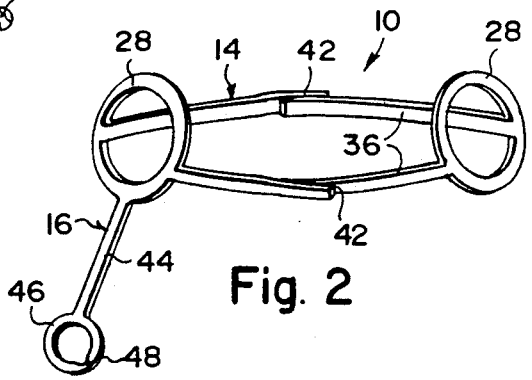
FIG. 2 is a front perspective view of just the invention showing hook and loop fabric fasteners therein.
Figure 3:
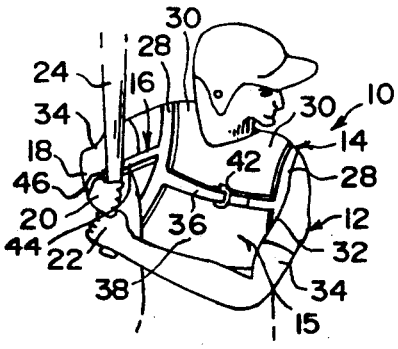
FIG. 3 is a front view of the batter wearing the instant invention and showing a buckle fastener therein.
Figure 4:
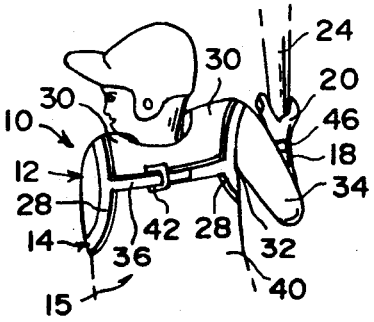
FIG. 4 is a rear view of FIG. 3.
Figure 5:
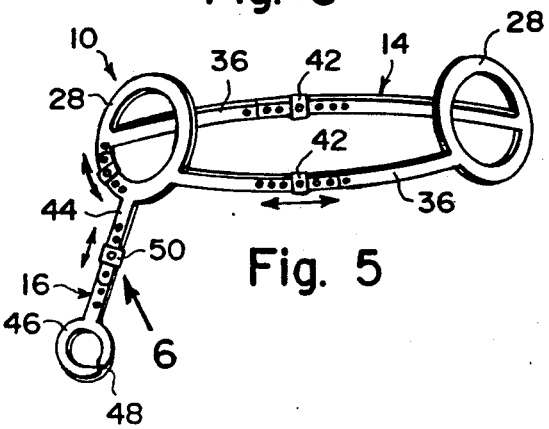
FIG. 5 is a front perspective view of a modification which is adjustable so that a right or left hand batter can utilize the invention.

The fasteners 42 can be hook and loop fabric fasteners as shown in FIGS. 1 and 2, while in FIGS. 3 and 4 they can be buckle fasteners. In FIG. 5 the fasteners 42 can be an adjustable clip on fastener.

Figure 6:
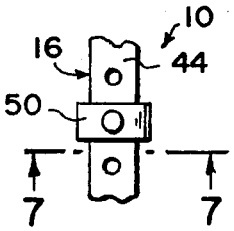
FIG. 6 is an enlarged detail view as indicated by arrow 6 in FIG. 5 showing one of the adjustable snap-on fasteners.
Figure 7:
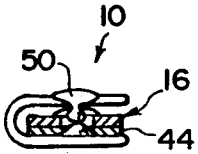
FIG. 7 is a cross sectional view taken along line 7—7 in FIG. 6 showing the adjustable snap-on fastener in greater detail.

The fastener 48 on the band 46 can also be a hook and loop fabric fastener, while the fastener 50, as shown in FIGS. 5, 6 and 7, can be an adjustable snap-on fastener.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bottom hand swing developer for a batter which comprises:

a) a harness worn on the upper torso of a batter;

b) a restraining member of predetermined length disposed between said harness and a wrist of a top hand of a batter so that the top hand will be restricted from domination of the batting swing, while the bottom hand will participate equally with the top hand when a batter swings the bat to hit the ball; said harness includes:

c) a pair of elastic loop members, each extending about the shoulder and armpit of each arm of the batter; one of said loop member connected to said restrainers member;

d) a pair of elastic straps connected between said loop members to extend across the front and back of the upper torso of a batter; and e) a pair of fasteners, each having means for adjutably securing the length of each said elastic strap between said loop members on the upper torso of a batter so that both right handed and left handed batters can utilize said harness by reversing the loop members from one shoulder to the other shoulder of a batter.

2. A bottom hand swing developer as recited in claim 1, wherein said restraining member includes:

a) an elastic extension member connected at one end to one of said elastic loop members of said harness;

b) a band connected to other end of said elastic extension member to be worn about the wrist of the top hand of a batter; and c) a fastener on said band for adjustably securing said band about the wrist of the top hand of a batter.

3. A bottom hand swing developer as recited in claim 2, further including a fastener for adjustably changing and retaining the length of said elastic extension member.

* * * * *